US009511374B2

(12) United States Patent
Ishikawa et al.

(10) Patent No.: US 9,511,374 B2
(45) Date of Patent: Dec. 6, 2016

(54) HORIZONTAL DRY MILL

(71) Applicant: ASHIZAWA FINETECH LTD., Narashino-shi, Chiba (JP)

(72) Inventors: Tsuyoshi Ishikawa, Narashino (JP); Naoki Hagiwara, Narashino (JP); Toshihiro Yamada, Narashino (JP)

(73) Assignee: ASHIZAWA FINETECH LTD., Narashino-Shi, Chiba (JP)

( * ) Notice: Subject to any disclaimer, the term of this patent is extended or adjusted under 35 U.S.C. 154(b) by 296 days.

(21) Appl. No.: 14/363,842

(22) PCT Filed: Dec. 6, 2012

(86) PCT No.: PCT/JP2012/081616

§ 371 (c)(1),
(2) Date: Jun. 9, 2014

(87) PCT Pub. No.: WO2013/084981

PCT Pub. Date: Jun. 13, 2013

(65) Prior Publication Data

US 2014/0367504 A1 Dec. 18, 2014

(30) Foreign Application Priority Data

Dec. 9, 2011 (JP) ..... 2011-269632

(51) Int. Cl.
*B02C 17/16* (2006.01)
*B02C 17/18* (2006.01)

(52) U.S. Cl.
CPC ..... *B02C 17/163* (2013.01); *B02C 17/16* (2013.01); *B02C 17/18* (2013.01); *B02C 17/183* (2013.01); *B02C 17/1835* (2013.01)

(58) Field of Classification Search
CPC ..... B02C 17/163; B02C 17/183; B02C 17/18; B02C 17/16; B02V 17/1835
(Continued)

(56) References Cited

U.S. PATENT DOCUMENTS 3,957,210 A 5/1976 Durr
4,844,355 A 7/1989 Kemp, Jr. et al.
(Continued)

FOREIGN PATENT DOCUMENTS

EP 0 015 647 A1 9/1980
JP 46-26537 B1 8/1971
(Continued)

OTHER PUBLICATIONS

First Examination Opinion Report (CN Application No. 201280060593.X) (7 pages—dated Mar. 2, 2015).
(Continued)

*Primary Examiner* — Mark Rosenbaum
(74) *Attorney, Agent, or Firm* — Renner, Kenner, Greive, Bobak, Taylor & Weber

(57) ABSTRACT

It is intended to, in a horizontal dry mill, prevent blow-up and adhesion of a raw material, etc., to a raw material input section. In a horizontal dry mill (10) of the present invention, a diameter of a raw material supply section (13) provided in a grinding tank (14) is set to be less than a diameter of a grinding chamber (12). Further, a diameter of a mechanical thrust generating device of the raw material supply section (13) is set to a small value according to the diameter of the raw material supply section. Furthermore, a gap (e1) between an outside dimension of a screw (26) as the mechanical thrust generating device and an inner diameter of the grinding tank (14) in the raw material supply section (13) is set between 0.5 mm and ⅓ of a diameter of each grinding medium M.

6 Claims, 4 Drawing Sheets

(58) Field of Classification Search
USPC ..... 241/172, 171
See application file for complete search history.

(56) References Cited

U.S. PATENT DOCUMENTS

| | | | | |
|---|---|---|---|---|
| 5,257,742 | A | 11/1993 | Yashima et al. | |
| 8,002,213 | B2 * | 8/2011 | Stehr | B02C 17/161 241/171 |

FOREIGN PATENT DOCUMENTS

| | | | |
|---|---|---|---|
| JP | 4-5237 | U | 1/1992 |
| JP | 4-193360 | A | 7/1992 |
| JP | 7-8034 | Y2 | 3/1995 |
| JP | 2000-126635 | A | 5/2000 |
| JP | 2007-319726 | A | 12/2007 |

OTHER PUBLICATIONS

European Search Report (128553567—PCT/JP2012/081616) (8 pages—dated Jun. 29, 2015).

* cited by examiner

HORIZONTAL DRY MILL

TECHNICAL FIELD

The present invention relates to a horizontal dry mill. The horizontal dry mill of the present invention is particularly suitable for use in, but not limited to, grinding to fine particles a raw material, such as alumina, silicon nitride, silicon carbide, dielectric material, magnetic material, iron oxide, silica, battery material, carbon, magnesium oxide, calcium carbonate, ceramics, inorganic material, or any other dry-pulverized material.

BACKGROUND ART

As a conventional horizontal dry mill, there has been known a type described in JP-U 7-8034B. The horizontal dry mill described in this publication comprises: a circular tubular grinding chamber having a raw material input nozzle disposed at one end thereof, a pulverized material discharge section disposed at the other end thereof, and a separator disposed adjacent to the discharge section; a screw serving as a thrust generating member disposed on the side of the one end of the grinding chamber; an agitation member rotatably provided in the grinding chamber and having a plurality of arms implanted around a rotary shaft to serve as agitation elements; and grinding media filled in the grinding chamber. In this horizontal dry mill, a raw material input into the grinding chamber through the material input nozzle is thrust toward the discharge section by the screw, so that it is agitated together with the grinding media and pulverized by means of mutual friction, shear, etc., whereafter a resulting pulverized product is separated from the grinding media by the separator and discharged from the discharge section.

However, in the above horizontal dry mill, the agitation element is a simple arm. Thus, when a raw material has high flowability, the raw material passes through the grinding chamber without filling an upper region of the grinding chamber and reaches the separator, so that a volumetric capacity of the grinding chamber cannot be sufficiently utilized, and a retention time of the raw material in the grinding chamber becomes shorter, which makes it impossible to effectively utilize the grinding media filled in the grinding chamber, causing significant deterioration in grinding efficiency.

Therefore, the applicant of this application previously offered a horizontal dry mill capable of increasing a retention time of a raw material in a grinding chamber and sufficiently bringing out a grinding ability of grinding media so as to efficiently perform grinding of the raw material, in JP 2007-319726A.

The horizontal dry mill proposed in the JP 2007-319726A comprises: a tubular grinding tank having a grinding chamber; a raw material input section provided at one end of the grinding tank; a media separation section provided at the other end of the grinding tank; grinding media set in the grinding chamber; and an agitation member provided between one end and the other end of the grinding chamber and disposed rotatably about a horizontal rotation axis, and is characterized in that the agitation member comprises a plurality of circular truncated cone-shaped discs each having a vertical surface and a taper surface with a size which gradually decreased toward the one end of the grinding tank, and a plurality of pins, which are arranged alternately, wherein each of the discs is formed with a communication hole extending obliquely in a thickness direction of the disc, and wherein the communication hole has a first opening located on the vertical surface at a position on a relatively inner peripheral side of the disc, and a second opening located on the taper surface at a position on an outer peripheral side of the disc with respect to the first opening.

As described above, in the horizontal dry mill proposed in the JP 2007-319726A, the plurality of circular truncated cone-shaped discs are used as a part of agitation elements of the agitation member, and the communication hole is formed in each of the discs to extend obliquely in the thickness direction of the disc, specifically, the communication hole is configured to have a first opening located on the vertical surface at a position on a relatively inner peripheral side of the disc, and a second opening located on the taper surface at a position on an outer peripheral side of the disc with respect to the first opening, so that the raw material and the grinding media on a downstream side of the disc partly flow back to an upstream side of the disc through the communication hole. The backflow makes it possible to increase a retention time of a material to be ground in the grinding chamber, and perform sufficient grinding. In particular, the backflow makes it possible to give large kinetic energy to the grinding media and increase a probability of contact between the grinding media, thereby enhancing grinding capacity. These allow the horizontal dry mill to perform fine grinding of the material.

Meanwhile, in the horizontal dry mill having the above structure, as for supply of a raw material to the grinding chamber, a raw material to be pulverized is discharged from a constant feeder, and directly input into the grinding chamber by means of gravity fall. In the horizontal dry mill, a raw material having a particle size of several 100 μm can be pulverized into several μm in just one pass. However, when the particle size is reduced to be equal to or less than 10 μm, cohesion rapidly becomes stronger, so that such particles are liable to re-cohere. Although a grinding aid is added to address prevention of such cohesion, the media and pulverized particles are pushed up to the material input section by a centrifugal force produced by rotation of the agitation member, and the material input section is apt to be clogged due to adhesion and buildup of particles increased in cohesion force, thereby precluding operation.

Moreover, a raw material with a low specific gravity has a disadvantage, such as a situation where it is blown up by a centrifugal force, thereby becoming incapable of being input into the grinding chamber.

In the horizontal dry mill proposed in the JP 2007-319726, the above disadvantage has been improved to some extent by providing a raw material supply section having a given length, on the side of one end of the agitation member, to allow a raw material to be input thereinto, and supplying the raw material input in the raw material supply section, to the grinding chamber by a screw or the like, instead of directly inputting the raw material into the grinding chamber in which the agitation member exists.

However, in this material supply section, a screw or the like is also used, so that, due to a centrifugal force produced by rotation of the screw or the like, blow-up and adhesion of the raw material, etc., to the raw material supply section, is likely to occur.

LIST OF PRIOR ART DOCUMENTS

Patent Documents

Patent Document 1: JP-U 7-8034 B
Patent Document 2: JP 2007-319726 A

DISCLOSURE OF THE INVENTION

Technical Problem

It is therefore an object of the present invention to provide a horizontal dry mill which is capable of preventing blow-up and adhesion of a raw material, etc., to a raw material input section.

Solution to the Technical Problem

The above object is achieved by the horizontal dry mill of the present invention having the following features described in (1) to (7).

(1)

A horizontal dry mill comprising: a grinding tank having a tubular grinding chamber, and a tubular raw material supply section continuously connecting to the grinding chamber to supply a raw material as a dry-pulverized material to the grinding chamber; a raw material input section provided at one end of the grinding tank; a raw material discharge section provided at the other end of the grinding tank via a media separation member; grinding media set in the grinding chamber; a horizontal, rotational driving shaft extending in the raw material supply section and the grinding chamber of the grinding tank; a raw material supply member disposed in the raw material supply section and attached to the horizontal, rotational driving shaft, wherein the raw material supply member is configured to supply the raw material input into the raw material supply section from the raw material input section, to the grinding chamber, while being rotationally driven by the horizontal, rotational driving shaft; and an agitation member disposed in the grinding chamber and attached to the horizontal, rotational driving shaft, wherein the agitation member is configured to agitate the raw material supplied from the raw material supply section, while being rotationally driven by the horizontal, rotational driving shaft. The horizontal dry mill is characterized in that the raw material supply member is a mechanical thrust generating device configured to be rotated to thereby give, to the raw material input from the raw material input section, thrust toward the grinding chamber, wherein a diameter of the raw material supply section is set to be less than a diameter of the grinding chamber, and a diameter of the mechanical thrust generating device is set to a small value according to the diameter of the raw material supply section, so as to prevent blow-up of the raw material input from the raw material input section into the raw material supply section.

(2)

The horizontal dry mill set forth in (1), wherein the mechanical thrust generating device is a screw, and wherein a gap between an outer diameter of the screw and an inner diameter of the grinding tank in the material supply section is between 0.5 mm and ⅓ of a diameter of each of the grinding media.

(3)

The horizontal dry mill set forth in any one of (1) to (2), wherein a radially-outer end of the screw is formed in a sharp shape by providing an acute-angled inclined relief surface on a side opposite to a transport surface of the screw, thereby preventing biting of foreign substances and the grinding media.

(4)

The horizontal dry mill set forth in (1) to (3), wherein the agitation member comprises a plurality of rectangular plate-like members each extending along the horizontal, rotational driving shaft and extending radially from the horizontal, rotational driving shaft, and wherein each of the plate-like members has a plurality of openings, and wherein each of a gap between a radially-outer side of the plate-like member and an inner diameter of the grinding tank in the grinding chamber, and a gap between a lateral side of the plate-like member adjacent to the media separation member and the media separation member is between 0.5 mm and ⅓ of a diameter of each of the grinding media.

(5)

The horizontal dry mill set forth in any one of (1) to (3), wherein the agitation member comprises a plurality of plate-like members each extending along the horizontal, rotational driving shaft and extending radially from the horizontal, rotational driving shaft, and wherein each of the plate-like members is formed with a rectangular opening extending radially outwardly from the horizontal, rotational driving shaft by a given length, thereby having an angular C-shape, and wherein each of a gap between a radially-outer side of the plate-like member and an inner diameter of the grinding tank in the grinding chamber, and a gap between a lateral side of the plate-like member adjacent to the media separation member and the media separation member is between 0.5 mm and ⅓ of a diameter of each of the grinding media.

(6)

The horizontal dry mill set forth in (4) or (5), wherein a radially-outer end of the plate-like member is formed in a sharp shape by providing an acute-angled inclined relief surface on an downstream side of the plate-like member in terms of its rotation direction, thereby preventing biting of foreign substances and the media.

(7)

The horizontal dry mill set forth in (1) or (2), wherein a diameter of the material supply section is set to about ⅓ to about ½ of a diameter of the grinding chamber.

Effect of the Invention

In the horizontal dry mill of the present invention, the raw material supply section is provided in the grinding tank in addition to the grinding chamber, and therefore the raw material input section is disposed in the raw material supply section, instead of being disposed in the grinding chamber, so that it becomes possible to prevent a situation where a pulverized material becoming more likely to cohere is directly pushed up to the raw material input section or a vicinity thereof by a centrifugal force of the agitation member. Further, in the horizontal dry mill of the present invention, the diameter of the raw material supply section is set to be less than the diameter of the grinding chamber, and the diameter of the mechanical thrust generating device is set to a small value according to the diameter of the raw material supply section, so that a centrifugal force to be produced by the mechanical thrust generating device becomes smaller, and therefore blow-up of the raw material input from the raw material input section into the raw material supply section and a push-up force against a pulverized material flowing back from the grinding chamber become weakened, thereby making it possible to maximally suppress clogging of the raw material input section.

In the horizontal dry mill of the present invention, the gap between the outer diameter of the screw as the mechanical thrust generating device and the inner diameter of the grinding tank in the material supply section may be set between 0.5 mm and ⅓ of a diameter of each of the grinding media. In this case, it becomes possible to prevent the grinding medium which can accelerate the push-up of the pulverized material and adhesion and buildup of the pulverized material to the raw material input section, from intruding in the raw material supply section, thereby further suppressing the push-up and the adhesion and buildup of the material.

In the same type of conventional dry media agitation mill, although an agitation member is disposed in opposed relation to an inner wall of a grinding chamber, with a gap equal to or greater than 3 times of a diameter of each media, it is often the case that a processed material adheres to the inner wall of the grinding chamber according to a centrifugal force produced by rotation of the agitation member, thereby precluding operation.

In the horizontal dry mill of the present invention, a component of the agitation member may be configured as a plate-like member, wherein the gap between the radially-outer side of the plate-like member and the inner diameter of the grinding tank in the grinding chamber may be set between 0.5 mm and ⅓ of a diameter of each of the grinding media, as defined in the appended claim 4 or 5. In this case, a pulverized material adhering to the inner wall of the grinding chamber can be scraped off to prevent buildup thereof.

In addition, a gap between the lateral side of the plate-like member adjacent to the media separation member and the media separation member may also be set between 0.5 mm and ⅓ of a diameter of each of the grinding media. In this case, a pulverized material adhering onto the media separation member can be scraped off to prevent the occurrence of clogging due to buildup thereof.

DESCRIPTION OF EMBODIMENTS

With reference to the accompanying drawings, horizontal dry mills according to various embodiment of the present invention will now be described.

Figure 1:
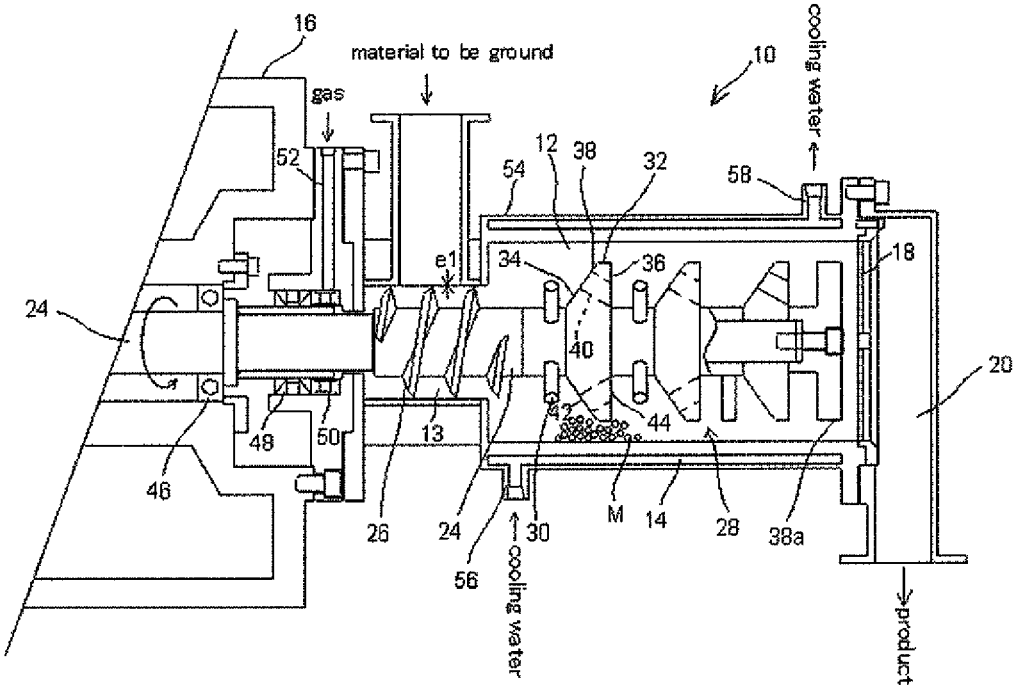
FIG. 1 is a sectional view illustrating a horizontal dry mill according to one embodiment of the present invention.

FIG. 1 illustrates a horizontal dry mill 10 according to one embodiment of the present invention. This horizontal dry mill 10 comprises a horizontal circular tubular grinding tank 14 internally having a grinding chamber 12 and a circular tubular material supply section 13 continuously connecting to the grinding chamber 12 in concentric relation to supply a raw material to the grinding chamber 12. Preferably, the grinding chamber 14 is made of a ceramic material, such as alumina, alumina-zirconia or silicon nitride as a heat-resistant material. The grinding tank 14 has one end (on an upstream side in terms of a flow of a raw material; this side will hereinafter be referred to as "one end" as for all members and components) provided with a casing 16, and the other end (on a downstream side in terms of the flow of the raw material; this side will hereinafter be referred to as "the other end" as for all members and components) provided with a media separation member (separator) 18 and a discharge box 20 for discharging a pulverized product therethrough. The material supply section 13 at the one end of the grinding tank 14 is provided with a material input nozzle 22 as illustrated in the figure. A structure of the media separation member (separator) 18 is not particularly limited. For example, it may be a plate-like member formed with a plurality of slits or holes.

A rotational driving shaft 24 is provided inside the grinding tank 14 to extend horizontally from the casing 16 to the grinding chamber 12 via the material supply section 13. The rotational driving shaft 24 is disposed in coaxial relation with the grinding tank 14. A screw 26 is provided inside the material supply section 13 and on the rotational driving shaft 24 at a position on the side of the one end (just below the material input nozzle 22) to serve as a mechanical thrust generating device for giving, to a material to be ground as a raw material input from the material input nozzle 22, thrust toward the other end, i.e., toward the grinding chamber 12. A first agitation arm 30 and a second agitation arm 32 which are agitation elements making up an agitation member 28 are provided inside the grinding chamber 12 and on the rotational driving shaft 24 at a position on the side of the other end with respect to the screw 26, and alternately arranged at intervals in an axial direction of the rotational driving shaft 24. The first agitation arm 30 is a pin-like member implanted on the rotational diving shaft 24. The second agitation arm 32 is a circular truncated cone-shaped disc 38 which has a taper surface with a size gradually decreasing toward the one end of the grinding tank 14 and a vertical surface 36. As illustrated in the figure, the disc 38 is formed with a plurality of communication holes 40 each extending obliquely in a thickness direction of the disc. It is preferable to provide the plurality of communication holes 40 in even intervals in a circumferential direction of the disc 38. Each of the communication holes 40 has a first opening 42 located on the vertical surface 34 at a position on a relatively inner peripheral side thereof, and a second opening 44 located on the taper surface 34 at a position on an outer peripheral side thereof with respect to the first opening 42. Based on the communication holes 40 provided in the disc 38, a backflow of a mixture of grinding media M and the material filled in the grinding chamber 12 occurs around the disc 38. Preferably, the agitation member 28 is further provided with a distal end arm **38*a* as illustrated in the figure, at its distal end (on a side closest to the media separation member 18). Preferably, the agitation member 28 is made of a ceramic material, such as zirconia, silicon nitride or alumina as an abrasion-resistant material. Preferably, the grinding media M is a type having a particle diameter of several mm, and is filled to account for about 50 to 75% of a volume of the grinding chamber 12**.

As illustrated in the figure, in the horizontal dry mill 10, a diameter of the raw material supply section 13 is set to be less than a diameter of the grinding chamber 12, and a diameter of the screw 26 as the mechanical thrust generating device is set to a small value according to the diameter of the raw material supply section 13. Preferably, the diameter of the raw material supply section 13 is set to be about ⅓ to ½ of the diameter of the grinding chamber 12. If the diameter of the raw material supply section 13 is reduced beyond the above range, supply of a material to be ground (raw material) to the grinding chamber 12 becomes insufficient, so that operational efficiency becomes poor. On the other hand, if it is increased beyond the above range, the diameter of the screw 26 is also increased, so that the centrifugal force suppression effect becomes insufficient.

Preferably, a gap e1 between an outer diameter of the screw 26 and an inner diameter of the grinding tank 14 in the material supply section 13 is set between 0.5 mm and ⅓ of the diameter of each of the grinding media. If a value of e1 is less than 0.5 mm, machine setting becomes more difficult, and, if it exceeds ⅓ of the diameter of each of the grinding media, the grinding media M is likely to be bitten between the radially-outer end of the screw 26 and the inner wall of the grinding tank 14.

Figure 2:
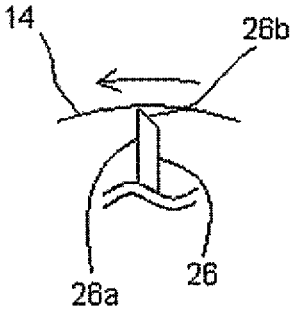
FIG. 2 is a schematic diagram illustrating a shape of a radially-outer end of a screw in FIG. 1.

Preferably, as illustrated in FIG. 2, the radially-outer end of the screw 26 is preferably formed in a sharp shape by providing an acute-angled inclined relief surface 26*b*, on a side opposite to a transport surface 26*a* of the screw 26, thereby preventing biting of foreign substances and the grinding media.

The rotational driving shaft 24 is rotatably supported by the casing 16 through a bearing 46 and connected to a driving source via a non-illustrated well-known driving mechanism in such a manner as to be rotationally driven. The rotational driving shaft 24 is sealed at a position between the bearing 46 and the screw 26, for example, by an oil seal 48, to maintain an inside of the grinding chamber 12 in a hermetically-sealed state. A lantern ring 50 is provided on the rotational driving shaft 24 at a position on the side of the grinding chamber 12 with respect to the oil seal 48 (a position adjacent to the oil seal), and a gas guide passage 52 is provided to communicate with the lantern ring 50. The gas guide channel 52 allows gas such as air to be introduced therethrough. The introduced gas flows into the grinding chamber 12 via the lantern ring 50 to prevent the raw material from intruding into the oil seal 48. The gas also has a function of fluidizing a material to be ground (powder), thereby enhancing flowability.

A jacket 54 is provided around an outer peripheral wall of the grinding tank 14 to form a space in cooperation with the grinding tank 14, and cooling water passes through an inside of the jacket 54 to cool the grinding tank and the grinding chamber. In the figure, the codes 56 and 58 denote a cooling water inlet nozzle and a cooling water outlet nozzle, respectively.

An operation of the above horizontal dry mill 10 will be described below.

First of all, when a fixed amount of material to be ground is supplied to the raw material supply nozzle 22 from an appropriate constant feeder (not illustrated), the material falls on the screw 26 in the grinding chamber 12, and is then thrust toward the other end of the grinding chamber 12 by the screw 26. In this process, thrust for the material is further increased by gas introduced through the gas guide channel 52.

The raw material is rotationally agitated together with the grinding media M by the agitation member 28 and gradually pulverized under pinching between the grinding media M, impulsive force and milling action, while being conveyed toward the other end through the grinding chamber 12. During the pulverization, a movement occurs in which a part of the raw material and the grinding media M is introduced into the first opening 42 of the disc 34 and discharged from the second opening 44 through the communication hole 40, so that a backflow is formed. This backflow makes it possible to increase a retention time of the raw material in the grinding chamber, so as to perform sufficient grinding. Particularly, this backflow makes it possible to give large kinetic energy to the grinding media, thereby increasing a probability of contact between the grinding media to enhance grinding capability.

The sufficiently pulverized and fine-powdered material is separated from the grinding media M by the media separation member (separator) 18 and collected as a product in the discharge box 20 after passing through the media separation member.

A problem can arise that a material to be ground (powder) tends to cohere along with pulverization, and becomes larger without being pulverized even if applying grinding energy. This problem can be overcome by adding a grinding aid, such as alcohol, from the raw material supply nozzle 22.

During the grinding operation, the grinding chamber 12 is maintained at a given temperature by circulating cooling water through the jacket 54.

In the above embodiment, the agitation member 28 is comprised of the first agitation arm 30 and the second agitation arm 32 attached to the rotational driving shaft 24. Alternatively, the agitation member 28 may be comprised of a plate member 100 as illustrated in FIGS. 3 and 4, or a plate-like member 200 as illustrated in FIGS. 5 and 6.

Figure 3:
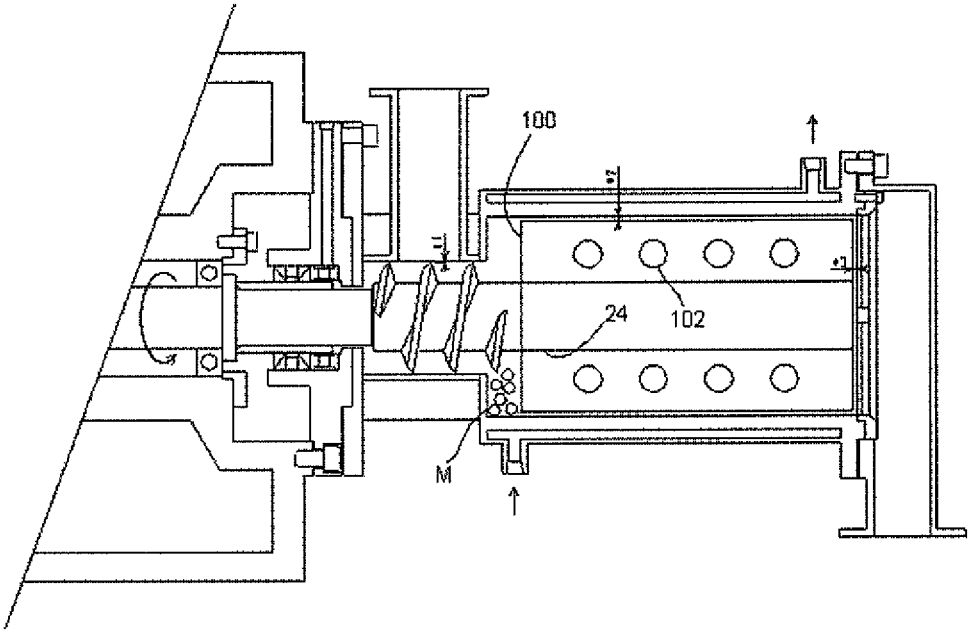
FIG. 3 is a sectional view illustrating a horizontal dry mill according to another embodiment of the present invention.
Figure 4:
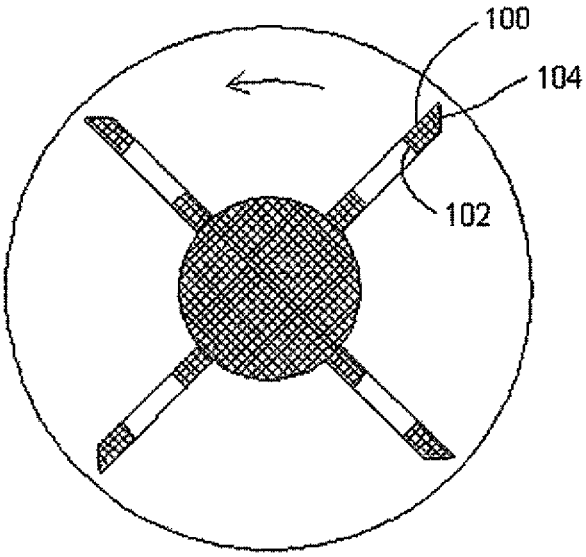
FIG. 4 is a sectional view illustrating a shape of an agitation member in FIG. 3.

The plate-like member 100 illustrated in FIGS. 3 and 4 is a plurality of rectangular plate-like members each extending along the horizontal, rotational driving shaft 24 and extending radially from the horizontal, rotational driving shaft. Each of the plate-like members 100 has a plurality of circular openings 102 to achieve backflow of a raw material and the grinding media M.

Figure 5:
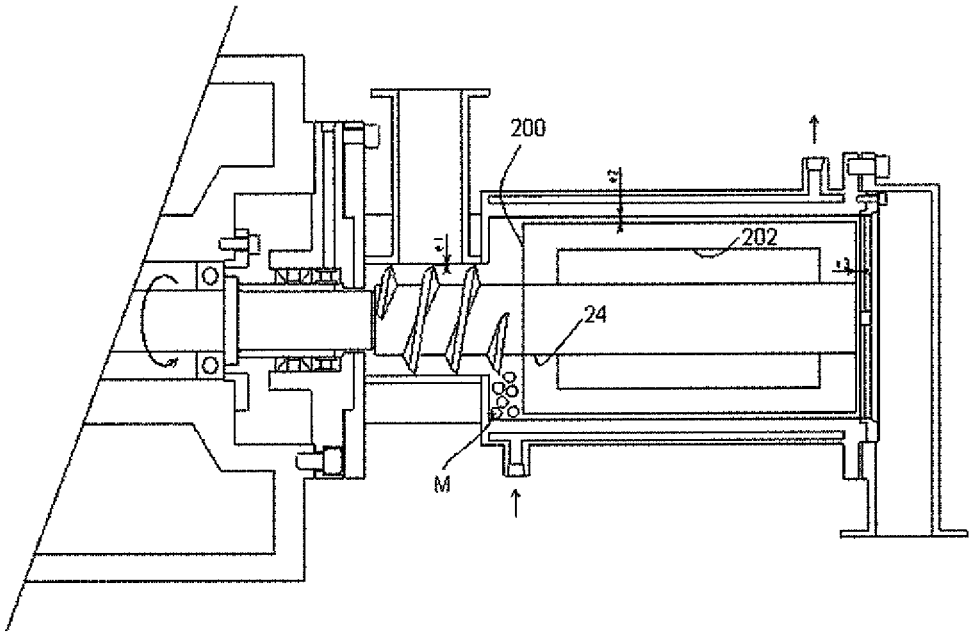
FIG. 5 is a sectional view illustrating a horizontal dry mill according to a yet another embodiment of the present invention.
Figure 6:
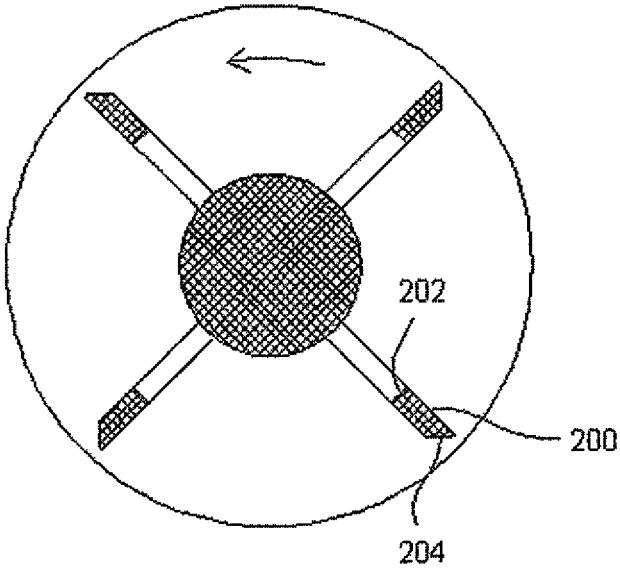
FIG. 6 is a sectional view illustrating a shape of an agitation member in FIG. 5.

The plate-like member 200 illustrated in FIGS. 5 and 6 is a plate-like member extending along the horizontal, rotational driving shaft 24 and extending radially from the horizontal, rotational driving shaft 24. The plate-like member 200 is formed with a rectangular opening 202 extending radially outwardly from the horizontal, rotational driving shaft 24 by a given length, to achieve backflow of a raw material and the grinding media M.

Preferably, each of a gap e2 between a radially-outer side of the plate-like member 100 (200) and an inner diameter of the grinding tank in the grinding chamber, and a gap e3 between a lateral side of the plate-like member adjacent to the media separation member and the media separation member 18 is between 0.5 mm and ⅓ of a diameter of each of the grinding media. In this case, it becomes possible to scrape off a pulverized material adhering to an inner wall of the grinding chamber and the media separation member to prevent buildup thereof. It also becomes possible to prevent grinding media, etc., from being bitten in the gap.

Further, as illustrated in FIG. 4 (6), a radially-outer end of the plate-like member 100 (200) is preferably formed in a sharp shape by providing an acute-angled inclined relief surface 104 (204), on a downstream side of the plate-like member in terms of its rotation direction, thereby preventing biting of foreign substances and the media.

Figure 7:
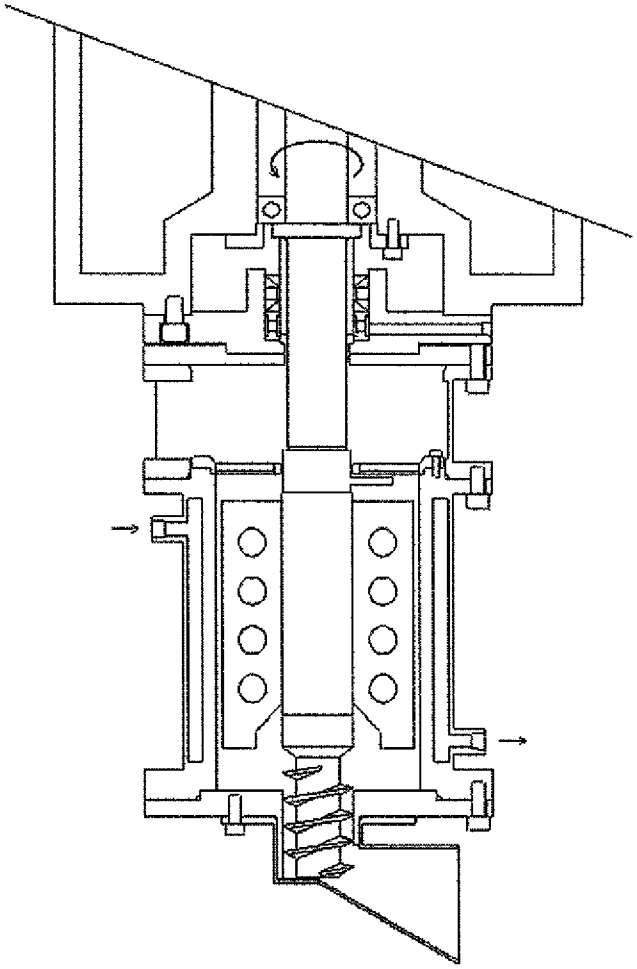
FIG. 7 is a sectional view illustrating a horizontal dry mill according to still another embodiment of the present invention.

Although the above embodiments have been described based on a structure in which the screw 26 and the agitation member 28 are arranged on the rotational driving shaft in this order from the side of the driving source, the arrangement between the screw 26 and the agitation member 28 may be reversed as illustrated in FIG. 7.

As mentioned above, in the horizontal dry mill of the present invention, the diameter of the raw material supply section is set to be less than the diameter of the grinding chamber, and the diameter of the mechanical thrust generating device is set to a small value according to the diameter of the raw material supply section, so that a centrifugal force to be produced by the mechanical thrust generating device becomes smaller, and therefore blow-up of the raw material input from the raw material input section into the raw material supply section and a push-up force against a pulverized material flowing back from the grinding chamber become weakened, thereby making it possible to maximally suppress clogging of the raw material input section.

EXPLANATION OF CODES

10 horizontal dry mill
12 grinding chamber
13 raw material supply section
14 grinding tank
16 casing
18 media separation member
20 discharge box
22 raw material input nozzle
24 rotational driving shaft
26 screw
26*a* transport surface
26*b* inclined surface
28 agitation member
30 first agitation arm
32 second agitation arm
34 taper surface
36 vertical surface
38 disc
40 communication hole
42 first opening
44 second opening
46 shaft bearing
48 oil seal
50 lantern ring
52 gas guide channel
54 jacket
56 cooling water inlet nozzle
58 cooling water outlet nozzle
100 plate-like member
102 opening
104 inclined surface
200 plate-like member
202 opening
204 inclined surface

What is claimed is:

1. A horizontal dry mill comprising:

a grinding tank having a tubular grinding chamber, and a tubular raw material supply section continuously connecting to the grinding chamber to supply a raw material as a dry-pulverized material to the grinding chamber;

a raw material input section provided at one end of the grinding tank;

a raw material discharge section provided at the other end of the grinding tank via a media separation member;

grinding media set in the grinding chamber;

a horizontal, rotational driving shaft extending in the raw material supply section and the grinding chamber of the grinding tank;

a raw material supply member disposed in the raw material supply section and attached to the horizontal, rotational driving shaft, wherein the raw material supply member is configured to supply the raw material input into the raw material supply section from the raw material input section, to the grinding chamber, while being rotationally driven by the horizontal, rotational driving shaft; and an agitation member disposed in the grinding chamber and attached to the horizontal, rotational driving shaft, wherein the agitation member is configured to agitate the raw material supplied from the raw material supply section, while being rotationally driven by the horizontal, rotational driving shaft, the horizontal dry mill is characterized in that the raw material supply member is a mechanical thrust generating device which is a screw configured to be rotated to thereby give, to the raw material input from the raw material input section, thrust toward the grinding chamber, wherein:

a diameter of the raw material supply section is set to be less than a diameter of the grinding chamber;

a diameter of the screw is set to a small value according to the diameter of the raw material supply section; and a gap between an outer diameter of the screw and an inner diameter of the grinding tank in the material supply section is between 0.5 mm and ⅓ of a diameter of each of the grinding media so as to prevent the grinding media from being clogged between the radially outer end of the screw and the inner wall of the grinding tank, and from intruding into the raw material supply section.

2. The horizontal dry mill as defined in claim 1, wherein a radially-outer end of the screw is formed in a sharp shape by providing an acute-angled inclined relief surface on a side opposite to a transport surface of the screw, thereby preventing clogging of foreign substances and the grinding media.

3. The horizontal dry mill as defined in claim 1, wherein the agitation member comprises a plurality of rectangular plate-like members each extending along the horizontal, rotational driving shaft and extending radially from the horizontal, rotational driving shaft, each of the plate-like members having a plurality of openings, and wherein each of a gap between a radially-outer side of the plate-like member and an inner diameter of the grinding tank in the grinding chamber, and a gap between a lateral side of the plate-like member adjacent to the media separation member and the media separation member is between 0.5 mm and ⅓ of a diameter of each of the grinding media.

4. The horizontal dry mill as defined in claim 1, wherein the agitation member comprises a plurality of plate-like members each extending along the horizontal, rotational driving shaft and extending radially from the horizontal, rotational driving shaft, each of the plate-like members being formed with a rectangular opening extending radially outwardly from the horizontal, rotational driving shaft by a given length, thereby having an angular C-shape, and wherein each of a gap between a radially-outer side of the plate-like member and an inner diameter of the grinding tank in the grinding chamber, and a gap between a lateral side of the plate-like member adjacent to the media separation member and the media separation member is between 0.5 mm and ⅓ of a diameter of each of the grinding media.

5. The horizontal dry mill as defined in claim 4, wherein a radially-outer end of the plate-like member is formed in a sharp shape by providing an acute-angled inclined relief surface on a downstream side of the plate-like member in terms of its rotation direction, thereby preventing clogging of foreign substances and the media.

6. The horizontal dry mill as defined in claim 1, wherein a diameter of the material supply section is set to about ⅓ to about ½ of a diameter of the grinding chamber.

* * * * *